United States Patent [19]

Onoue et al.

[11] Patent Number: 4,936,792

[45] Date of Patent: Jun. 26, 1990

[54] FLEXIBLE PRINTED CABLE CONNECTOR

[75] Inventors: Nobuaki Onoue, Sagamihara; Akira Imai, Yokohama, both of Japan

[73] Assignee: AMP Incorporated, Harrisburg, Pa.

[21] Appl. No.: 346,266

[22] Filed: May 1, 1989

Related U.S. Application Data

[63] Continuation of Ser. No. 182,697, Apr. 18, 1988, abandoned.

[30] Foreign Application Priority Data

May 1, 1987 [JP] Japan ..... 62-108745

[51] Int. Cl.[5] ..... H01R 13/639

[52] U.S. Cl. ..... 439/329; 439/67; 439/493

[58] Field of Search ..... 439/65, 67, 75, 77, 439/329, 387, 409, 410, 493, 495, 499, 496, 498, 792, 70; 174/52.3, 52.4

[56] References Cited

U.S. PATENT DOCUMENTS

| | | | |
|---|---|---|---|
| 3,271,625 | 9/1966 | Caracciolo | 179/52.4 X |
| 3,336,564 | 8/1967 | McCaughey | 439/391 |
| 3,423,638 | 1/1969 | Dix et al. | 439/70 X |
| 4,334,728 | 6/1982 | Reynolds et al. | 439/267 |
| 4,367,006 | 1/1983 | Rehbogen, Jr. et al. | 439/495 |
| 4,426,125 | 1/1984 | Crawford | 439/404 |
| 4,639,063 | 1/1987 | Mueller | 439/325 |
| 4,640,562 | 2/1987 | Shoemaker | 439/77 |
| 4,718,859 | 1/1988 | Gardner | 439/329 |

*Primary Examiner*—Eugene F. Desmond
*Attorney, Agent, or Firm*—Adrian J. LaRue

[57] ABSTRACT

An electrical connector for connecting a flexible printed cable (14, 23) to a circuit board 13 comprises a dielectric housing (3, 10, 20) having electrical contact members (**2*a*, 11, 21) secured in opposing sides of the housing, the contact members having contact sections (2*a*, 11A, 21*c*) inside of the housing for electrical connection to exposed conductors of the flexible printed cable when a section is positioned in the housing and maintained in connection therewith by a cover member (4, 12, 22) which is pivotally mounted on the housing and latched hereto by latch members (10A, 12A; 20*b*, 22*a*). Leg members (2*b*, 11B, 11C, 11d, 11E, 21*a*) of the contact members (2*a*, 11, 21**) have terminating sections that are disposed along a bottom of the housing or extend outwardly from the housing in a plane of the bottom surface of the housing for electrical and mechanical connection to respective coductive and metal areas on a surface of the circuit board or the terminating section extend parallel to the sides of the housing and extend through holes in the circuit board for electrical and/or mechanical connection to conductive and metal areas on a bottom surface of the circuit board.

23 Claims, 9 Drawing Sheets

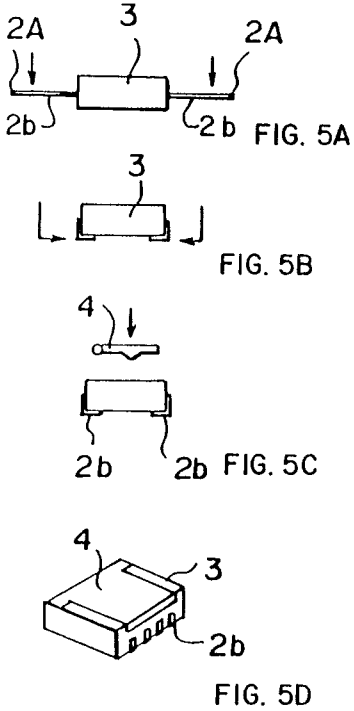
2A
2b
3
2A
2b
FIG. 5A
3
FIG. 5B
4
2b
2b
FIG. 5C
3
2b
4
FIG. 5D
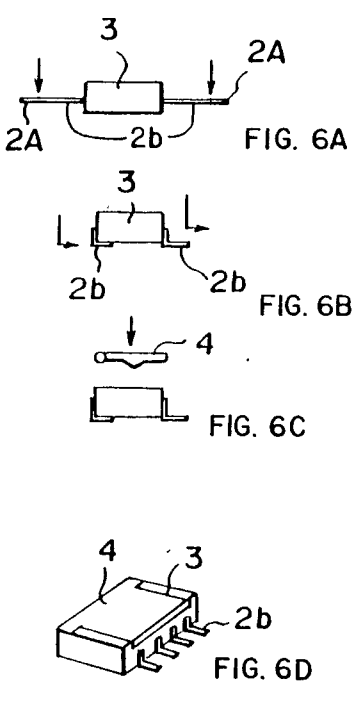
2A
3
2b
2A
FIG. 6A
3
2b
2b
FIG. 6B
4
FIG. 6C
3
2b
4
FIG. 6D
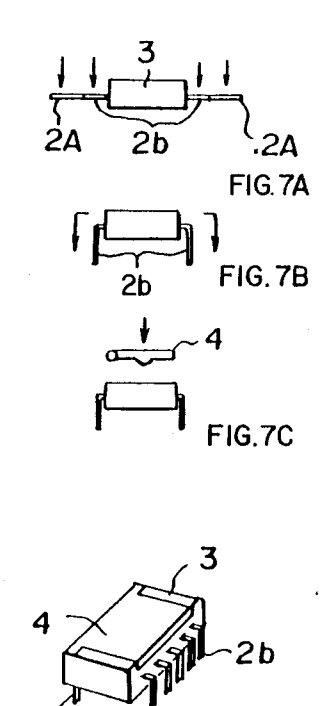
3
2b
2A
.2A
FIG. 7A
2b
FIG. 7B
4
FIG. 7C
3
2b
4
2b
FIG. 7D

FLEXIBLE PRINTED CABLE CONNECTOR

This application is a continuation of application Ser. No. 182,697, filed April 18, 1988, now abandoned.

FIELD OF THE INVENTION

This invention relates to an electrical connector, and more particularly to an electrical connector for connecting a flexible printed cable to a printed circuit board.

BACKGROUND OF THE INVENTION

Electrical connectors that are connected to printed circuit boards include the type which have terminating sections of electrical contacts that are inserted into holes in the printed circuit board and are soldered to conductive areas of the circuit board. The surface mount type of electrical connector has electrical contacts whereby the terminating sections are surface soldered to conductive areas on the printed circuit board thereof. Recently, because of higher complexity and greater compactness of circuits on the printed circuit board, connector contact spacing has become smaller (for example, 1 mm); correspondingly, it has become difficult to drill holes close enough in the printed circuit board, thus the need for surface mount connectors has been increasing.

In surface mount connectors, aside from electrical connection to the printed circuit board, there is also a need to mechanically secure the connector thereto. This was previously done either by providing a projection on the bottom of the connector and inserting it into a hole in the printed circuit board to secure it thereon, or by a metal plate on the bottom of the connector and soldering it to the printed circuit board.

In the former case, it is necessary to machine holes in the printed circuit board for insertion of the projections; it is also necessary to provide the projections on the connectors, thereby creating disadvantages from the standpoint of connector-manufacturing costs or securing the connectors to circuit boards. In the latter case, extra surface area is taken up by the metal plate on the printed circuit board, especially where demands are strong for higher density and greater compactness, thereby creating the problem that effective surface area on the printed circuit board is reduced.

SUMMARY OF THE INVENTION

The connector of the present invention has a dielectric housing that is insert molded onto a plurality of electrical contacts having contact sections located inside the housing and legs having terminating sections extending outside of the housing with some of the terminating sections being used for electrical connection to conductive areas of the printed circuit board while other of the terminating sections are used for mechanical connection to metal areas of the printed circuit board thereby electrically and mechanically connecting the connector to the circuit board.

The electrical contacts are in strip form and have carrier strips at both ends. Dielectric housings are insert molded as one piece on to the electrical contacts with two carrier strips outside the housings. According to such structure, legs of contacts extend from both sides of the housings, and legs on both sides are used for various forms of terminating sections.

By insert molding the housings onto the electrical contacts as one piece and using some of the legs of these contacts for electrical connection to the printed circuit board and other of the legs for mechanical securing to the printed circuit board, there is no need provide a projection or metal plate for such mechanical securing. The construction of the connector can therefore be simplified, and high density surface mounting on the printed circuit board is made possible.

Electrical connection according to this invention means that the contact-terminating sections extend in the same plane as the printed circuit board to which the connector is to be mounted and the contact terminating sections are soldered onto the conductive areas on the printed circuit board. Mechanical connection, meanwhile, means that the contact-terminating sections extend in the same plane as the printed circuit board or are inserted into holes in the printed circuit board and soldered to metal areas on the circuit board and/or in the holes.

BRIEF DESCRIPTION OF THE DRAWINGS

The invention, together with objects and advantages thereof, is best understood by way of example with reference to the following attached description in conjunction with the accompanying drawings.

FIGS. 5A–5D are diagrammatic views showing the formation of the contact legs into terminating sections and applying of a cover member onto the housing.

FIGS. 6A–6D and 7A–7D are views similar to FIGS. 5A–5D showing embodiments of the invention.

DETAILED DESCRIPTION OF THE INVENTION

Figure 1:
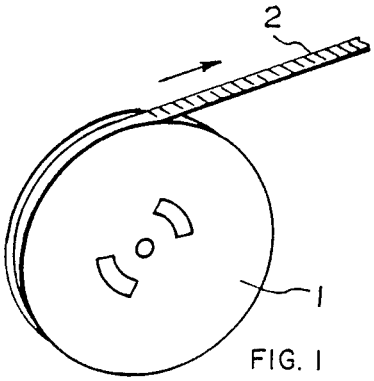
FIG. 1 is a perspective view of the electrical contacts for use in making the connector of the present invention which are in strip form and wound onto a reel.
Figure 2:
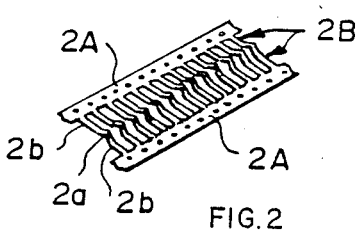
FIG. 2 is a perspective view of a part of the strip of contacts.
Figure 3:
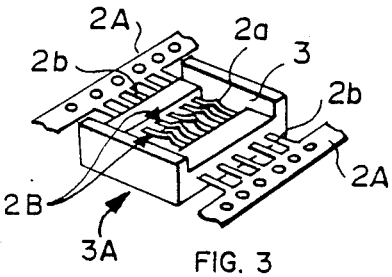
FIG. 3 is a perspective view of a part of the contract strip with a dielectric housing molded onto electrical contacts of the strip.
Figure 4:
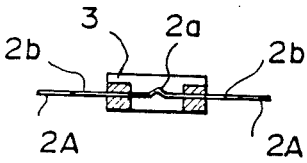
FIG. 4 is a cross sectional view of FIG. 3.

As shown in FIG. 1, contacts 2, which are stamped and formed in strip form, are wound on reel 1. As the strip is unwound from reel 1, a portion is cut off as shown in FIG. 2. As shown in FIG. 3, to this strip portion a dielectric-housing 3 is insert molded as one piece thereby forming connector 3A which has carrier strips 2A along both sides, and a plurality of contacts 2B are disposed in parallel between the carrier strips. Contact sections *2a* are located inside housing 3, which is open in the middle, as shown in FIG. 4, and legs 2*b* extend outside each side of housing 3. Cutting off carrier strips 2A provides a basic connector construction with the legs 2*b* extending outward on both sides of the housing.

By forming the legs 2*b* of the contacts in a connector constructed in this way to various configurations, printed circuit board connectors for use with various applications can be realized.

FIGS. 5A–5D show one of such a connector. First, legs 2*b* are cut at the position indicated by the arrows in FIG. 5A, and carrier strips 2A are cut off. Next, legs 2*b* are bent downward, and are further bent so as to extend along the bottom of connector housing 3 as shown in FIG. 5B. After this, the cover 4 to housing 3 is inserted thereon (FIG. 5C). In this fashion, a connector with contact legs 2*b* bent downward and inward is completed, as shown in FIG. 5D. Of the contact legs 2*b*, for example, the legs 2*b* on one side can be used as terminating sections for electrical connection to conductive areas of the printed circuit board, and the legs 2*b* on the other side can be used as terminating sections for mechanical securing of the connector to the printed circuit board.

FIGS. 6A–6D show another form of the connector wherein, first, carrier strips 2A, are cut off in the same way as in FIG. 5A (FIG. 6A). Next, the legs 2*b* on the left side of the housing are bent along the bottom of housing 3, and legs 2*b* on the right side of the housing are bent outward so that they follow the bottom surface of housing 3 (FIG. 6B). By attaching cover 4 (FIG. 6C) to the connector, a connector with contact legs 2*b* on one side bent inward and on the other side bent outward is completed, as shown in FIG. 6D. It is possible to use the legs bent inward for mechanical securing, and the legs bent outward for electrical connection. They may also be used in the reverse manner.

FIGS. 7A–7D show a further form of the connector wherein, as shown in FIG. 7A, carrier strips 2A are cut off, and both legs 2*b*, are bent downward (FIG. 7B). By attaching upper cover 4 to the connector (FIG. 7C), a connector with legs 2*b* extending downward is completed, as shown in FIG. 7D. Legs 2*b* along one side of the connector are disposed in holes in the printed circuit board and electrically connected thereto by soldering, while the legs 2*b* along the other side of the housing are similarly mechanically secured by insertion into holes in the printed circuit board and soldered thereto.

A portion of the legs 2*b* extending downward is bent outward so as to be in the plane of the bottom surface of housing 3; these portions of the legs are terminating sections to be electrically connected to the conductive areas on the upper surface of the printed circuit board. The legs 2*b* which extend straight downward penetrate through holes in the printed circuit board and are connected to conductive areas on the bottom surface of the printed circuit board, so that it is possible to connect to conductive areas on both sides of the printed board. In this case, mechanical securing to the printed circuit board can be done by using some legs selected from among the plurality of legs 2*b*.

FIGS. 8, 9, 10A–10F depict a more concrete example of a connector 15 based on the connectors in FIGS. 5–7.

A space is located inside housing 10 in which contact sections 11A of contacts 11, which are insert molded as one piece therewith, are exposed in such space. The legs 11B of contacts 11 extend outside of housing 10 and are bent downward. Pivot sections 12A of upper cover 12 are disposed in pivot-receiving sections 10A of housing 10, thereby enabling cover 12 to pivot between an open position to a closed position on housing 10. Latch 12B on upper cover 12 snaps in engagement with latch 10B on housing 10 with cover 12 engaging shoulders 10C of housing 10 thereby latching cover 12 in the closed position on housing 10.

Figure 10A:
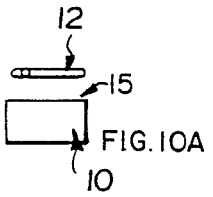
FIGS. 10A–10F are diagrammatic representations of connecting a connector onto a circuit board, connecting and disconnecting a flexible printed cable to the connector of FIGS. 8 and 9.
Figure 10B:
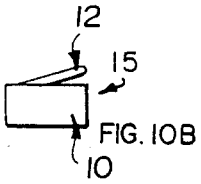
Figure 10C:
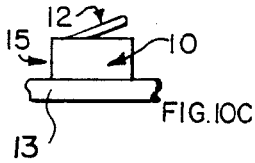
Figure 10D:
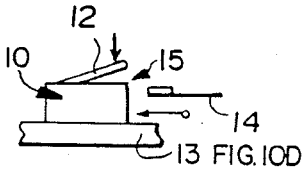
Figure 10E:
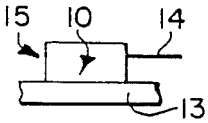
Figure 10F:
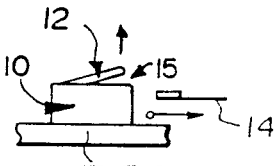

In use, as shown in FIGS. 10A–10F, connector 15 is mounted on print circuit board 13 in a partly-open condition without cover 12 being in a latchably-closed position (FIG. 10B); specified portions of the contact legs 11B are soldered to the conductive areas on printed circuit board 13 and electrically connected thereto, while the other contact legs 11B are soldered to the mechanical anchoring portion of printed circuit board 13, thus enabling connector 15 to be electrically connected and mechanically secured on board 13 (FIG. 10C). Next, as shown in FIG. 10D, flexible printed cable (FPC) 14 is inserted in connector 15 between cover 12 and housing 10, whereafter cover 12 is closed and latched with the exposed electrical conductors of cable 14 in electrical engagement with the contact sections 11A inside housing 10 (FIG. 10E). To disconnect cable 14, cover 12 is opened and cable 14 is pulled from connector 15 and electrically disconnected therefrom (FIG. 10F). Cover 12 in its latchably-closed position maintains the exposed conductors of cable 14 in electrical engagement with the spring contact sections 11A.

Figure 8:
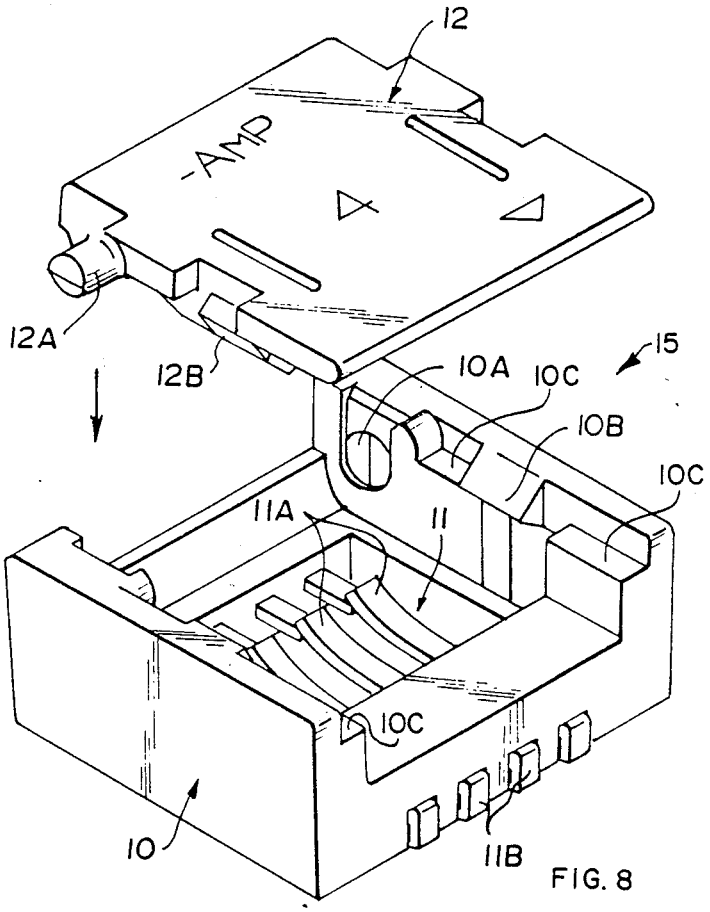
FIG. 8 is an exploded perspective view showing the electrical connector in greater detail.
Figure 9:
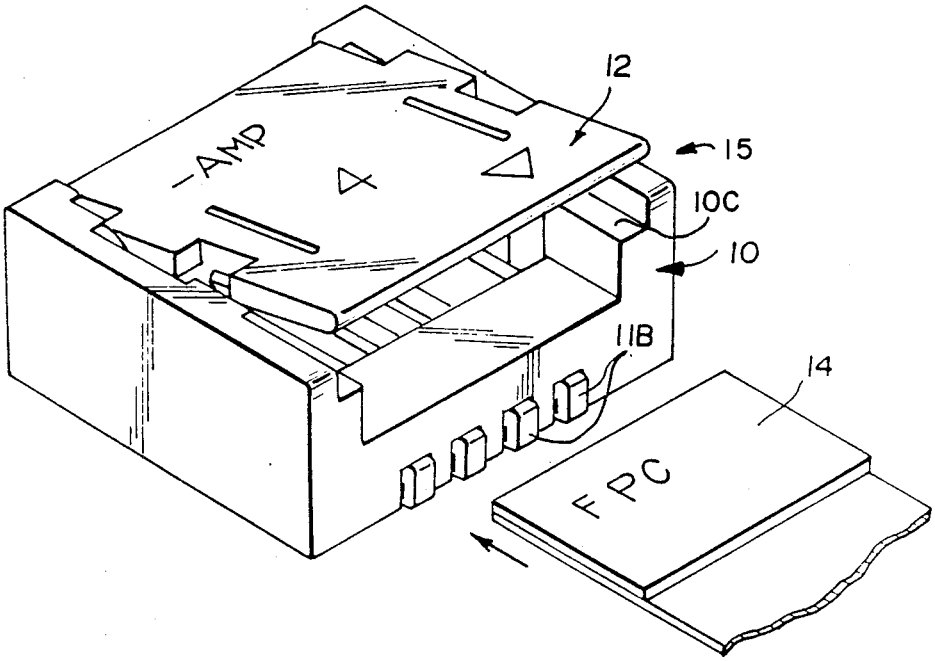
FIG. 9 is a view similar to FIG. 8 showing the assembled connector with an end of a flexible printed circuit exploded therefrom.

Contact sections 11A of contacts 11 are shown cut in FIG. 8, but may also be connected.

Figure 11:
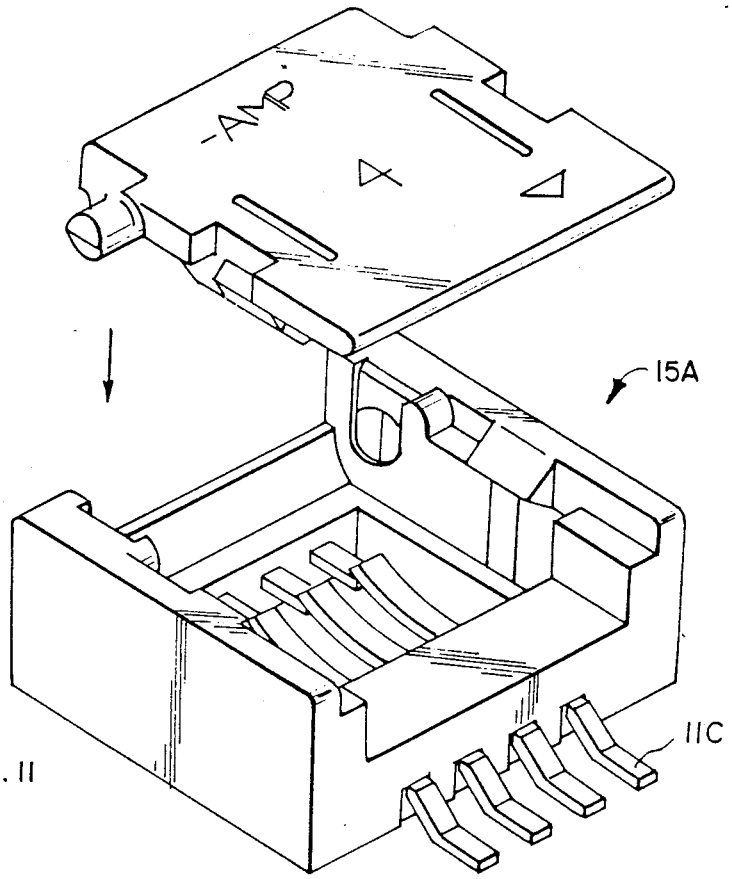
FIGS. 11, 12 and 13, 14 are views similar to FIGS. 8, 9 showing alternative embodiments of the connector.
Figure 12:
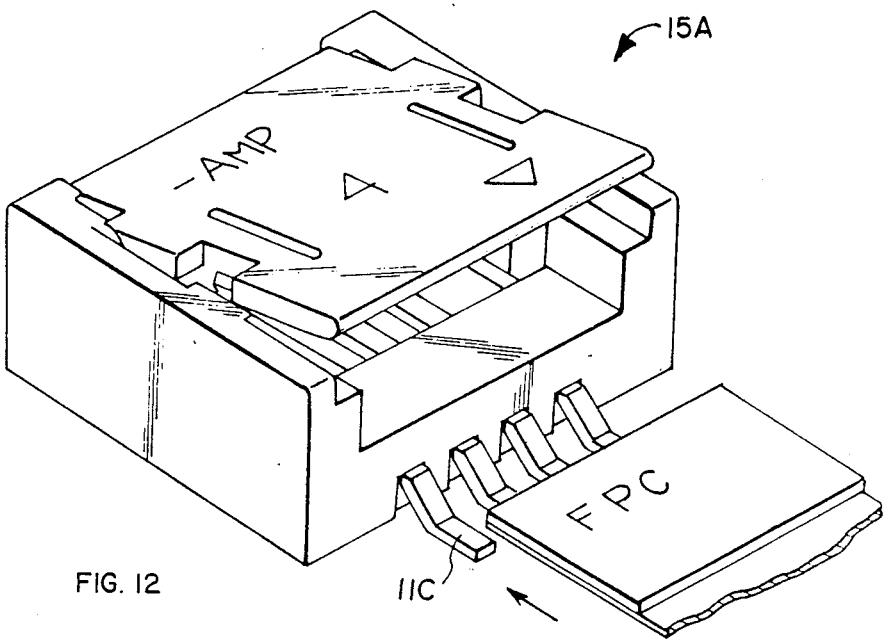

Connector 15A, as shown in FIGS. 11 and 12, has the legs 11C on one side bent outward and extending along the plane of the bottom of the housing, whereas legs on the opposite side are bent inward in the same way as legs 11B in FIG. 8. If desired, these may also be bent outward.

The steps for inserting and disconnecting the FPC is the same as shown in FIGS. 10A–10F.

Figure 13:
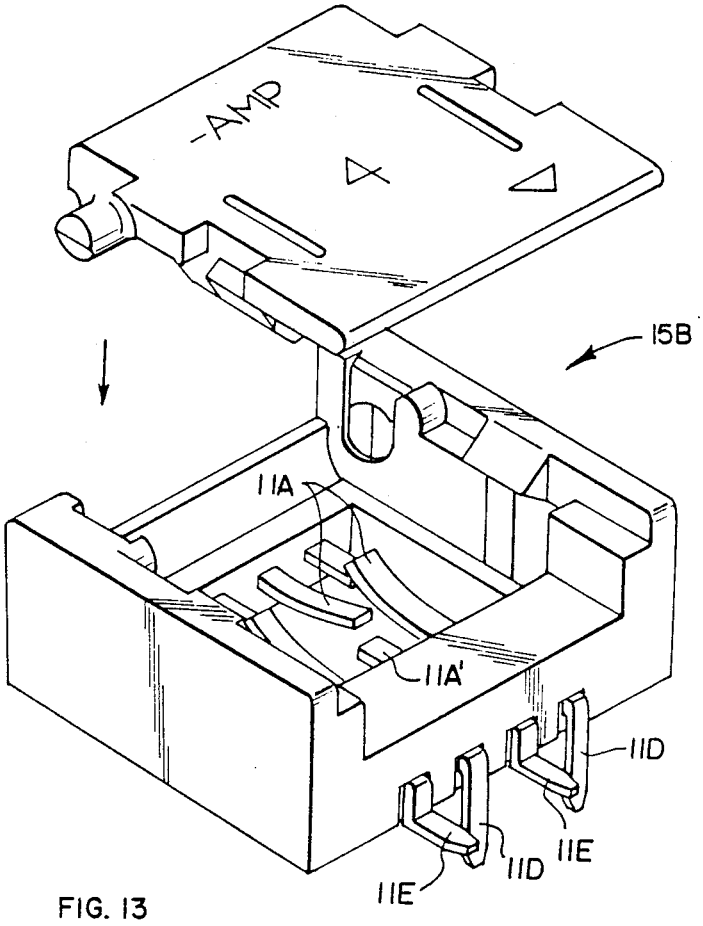
Figure 14:
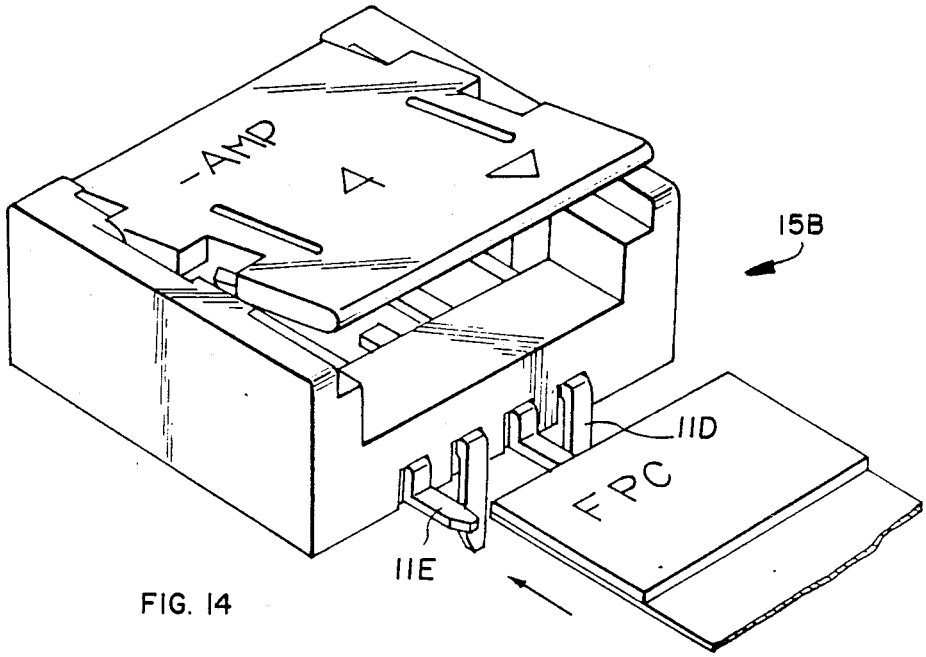

FIGS. 13 and 14 show connector 15B in which legs 11D extend outward from and extend downward along the side of the housing, whereas legs 11E are bent outward so that they are disposed in the plane of the bottom surface of the housing. In connector 15B, the contact sections 11A of the downwardly-bent legs 11D are curved upward in the same manner as that of connectors 15, 15A so that they can electrically engage with the exposed conductors of cable 14 when inserted therein. The contact sections 11A' of legs 11E, which are bent outward, are cut from contact sections 11A and do not electrically engage with cable 14. Therefore even if legs 11E are soldered to the printed circuit board, they will not function as electrical contacts and have only a mechanical-anchoring function. Of course, if the portion of the printed circuit board which connects to legs 11E is part of the electrically conductive pattern, the contact sections 11A' of legs 11E may, as do the contact sections 11A of the other legs 11D, engage the FPC.

Figure 15:
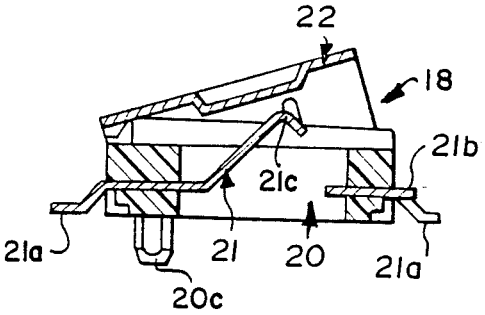
FIG. 15 is a cross-sectional view of a further alternative embodiment of the connector.
Figure 16:
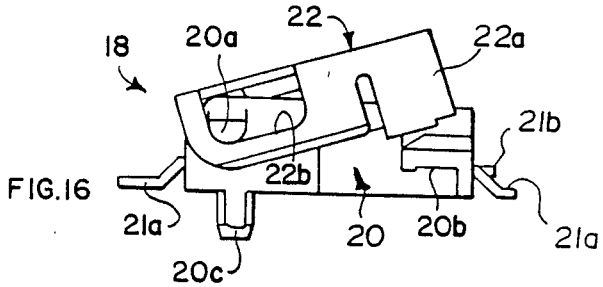
FIGS. 16, 17 and 18 are side-elevational view of the connector in its open, closed and latched and unlatched positions, respectively.
Figure 17:
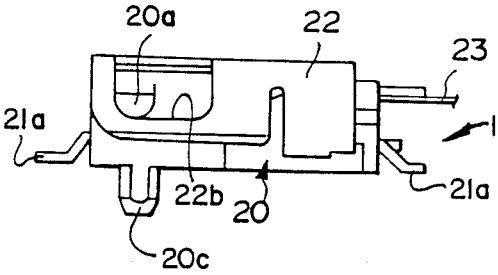
Figure 18:
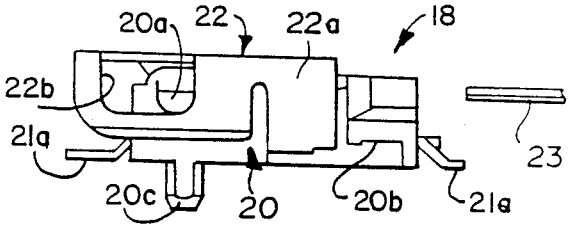

Connector 18 is shown in FIGS. 15 to 18 and has an upper cover 22 that slides backward on dielectric housing 20. FPC cable 23 is inserted in connector 18 with the cover 22 open as shown in FIGS. 15 and 16, after which upper cover 22 is moved downwardly moving the exposed conductors of cable 23 in electrical engagement with contact sections 21*c* of electrical contacts 21 that have been inserted molded in opposing sides of housing 20 as described above. Cover 22 moves rearwardly as a result of rectangular openings 22*b* in the sides of cover 22 in which pivot projections 20*a* of housing 20 are located enabling cover 22 to move between the open and closed positions. When cover 22 is in engagement with the top of housing 22 in a back position, as shown in FIG. 18, cover 22 can now be slid forward so that inwardly-directed projections at the ends of legs 22*a* of cover 22 can engage surfaces 20*b* on the front of housing 20, as shown in FIG. 17, thereby securing cover 22 in position on housing 20. The spring forces exerted by contact sections 21*c* against cable 23 and against cover 22 maintain cover 22 in its closed position on housing 20. Cover 22 can be moved backward, as shown in FIG. 18, which enables cable 23 to be removed from connector 18.

Pivot projections 20*a* have arcuate bottom surfaces and the bottom corners of openings 22*b* are arcuate to enable cover 22 to pivot and slide relative to housing 20.

The legs 21*a* of contacts are bent so that those which connect to the printed circuit board face downward at an angle, and those legs 21*b* which do not connect the circuit board are cut short in the middle so that they do not reach the printed circuit board. Of course, legs 21*b* can be bent like legs 21*a* and soldered to metal areas on the circuit board or extend through holes in the circuit board and soldered to metal areas on the bottom surface or in the holes of the circuit board. Mounting projections 20*c* can extend outwardly from the bottom surface of housing 20 insertion in holes in the circuit board for mechanically securing the connector on the circuit board.

In the connector of this invention, as is clear from the aforementioned examples, an upper cover which can be freely opened and latchably closed is provided on a housing; an FPC is inserted therein and electrically connected to the contacts therewithin, and legs of the contacts which extend outward from the housing have some that are electrically connected to conductive areas on a circuit board while other legs are used for mechanical anchoring to metal areas on the circuit board so it is possible to realize a printed circuit board connector which makes possible high density packaging based on an extremely simple construction.

Using some of the plurality of legs for electrical connection and the others for mechanical anchoring does not necessarily mean that all of the legs must be used in one way or the other; it goes without saying that in packaging, a design may result in legs which are not used at all.

We claim:

1. An electrical connector for connecting a flexible printed cable to a circuit board, comprising;

a dielectric housing having electrical contact members secured in opposing sides of the housing, the contact members having contact sections inside of said housing for electrical connection to exposed conductors of the flexible printed cable when a section of the cable is positioned in the housing;

a cover member pivotally mounted on the housing to move from an open position to enable the cable to be positioned in the housing and a closed position with the contact sections electrically engaging the exposed conductors of the cable;

latch means provided on the cover member and the housing for latching the cover member in said closed position;

leg members of the contact members extending outwardly from the housing with some of the leg members being electrically connectable to conductive areas of the circuit board while the other of the leg members are mechanically connectable to metal areas of the circuit board and further some of said leg members include sections extending along the bottom of the housing and other of said leg members include sections extending outwardly from the housing in the same plane of the bottom surface of the housing.

2. An electrical connector as claimed in claim 1, wherein the leg members have sections with some of the sections extending outwardly from the housing in the same plane of the bottom surface of the housing while other of the sections extend parallel to the sides of the housing.

3. An electrical connector as claimed in claim 1, wherein the leg members have sections with some of the sections extending outwardly from the housing in the same plane of the bottom surface of the housing while other of the sections are cut off.

4. An electrical connector as claimed in claim 3, wherein projections extend outwardly from the bottom of the housing for insertion into holes in the circuit board.

5. An electrical connector as claimed in claim 1, wherein said housing has pivot projections and said cover member has rectangular openings in which said pivot projections are disposed enabling said cover member to slidably move along the housing.

6. An electrical connector as claimed in claim 5, wherein the latch means comprise inwardly directed projections at the ends of legs of the cover member that engage surfaces on the other sides of the housing.

7. An electrical connector for electrically connecting electrical conductors of a flat cable to a printed circuit board, comprising:

a dielectric housing having electrical contact members secured therein at spaced intervals corresponding to the spacing of the electrical conductors of the flat cable, said contact members having spring contact sections and leg sections, said spring contact sections being within said housing for electrical connection to exposed conductors of the flat cable when a section of the flat cable is positioned within the housing while said leg sections extend outwardly from said housing for electrical connection to conductive areas of the printed circuit board;

a cover member; mounting means on said housing and said cover member enabling said cover member to pivot between an open position so that the section of the flat cable can be positioned between said housing and said cover member and a closed position with the exposed conductors in electrical engagement with the spring contact sections whereafter said cover member is slidable along said housing to a latching position; and latch means on the cover member and the housing for latching the cover member in the closed position.

8. An electrical connector as claimed im claim 7, wherein said mounting means comprise pivot projections on said housing and said cover member has rectangular openings in which said pivot projections are exposed.

9. An electrical connector as claimed in claim 7, wherein said latch means comprise inwardly-directed projections on said cover member that engage surfaces of said housing.

10. An electrical connector as claimed in claim 7, wherein some of said leg sections are connectable to metal areas on printed circuit board serving to mechanically secure the connector thereonto.

11. An electrical connector as claimed in claim 7, wherein projections extend outwardly from the bottom of the housing for insertion into holes in the circuit board.

12. An electrical connector for electrically connecting electrical conductors of a flat cable to a printed circuit board, comprising;

spaced electrical contact members having contact sections and leg sections;

a rectangular-shaped dielectric housing molded onto parts of the leg sections so that exterior parts of the leg sections extend outwardly from front and rear surfaces of the housing and the contact sections are positioned within said housing, some of the exterior parts of the leg sections being electrically connectable to conductive areas of the printed circuit board while the other of the exterior parts of the leg sections are mechanically connectable to metal areas of the printed circuit board;

a cover member pivotally mounted on the housing to move from an open position to enable the cable to be positioned in the housing and a closed position with the contact sections electrically engaging exposed conductors of the flat cable; and latch means on the cover member and the housing for latching the cover member in the closed position.

13. An electrical connector as claimed in claim 12, wherein the exterior parts of the leg sections have sections extending along the bottom of the housing.

14. An electrical connector as claimed in claim 12, wherein the exterior parts of the leg sections have sections with some of the sections extending along the bottom of the housing while other of the sections extend outwardly from the housing in the same plane of the bottom surface of the housing.

15. An electrical connector as claimed in claim 12, wherein the exterior parts of the leg sections have sections that extend parallel to the respective sides of the housing for disposition in holes in the circuit board.

16. An electrical connector as claimed in claim 12, wherein the exterior parts of the leg sections have sections with some of the sections extending outwardly from the housing in the same plane of the bottom surface of the housing while the other of the sections extend parallel to the sides of the housing and below the bottom surface plane.

17. An electrical connector as claimed in claim 12, wherein some of the exterior parts of the leg sections extend outwardly from the housing in the same plane of the bottom surface of the housing while the other of the exterior parts of the leg sections are cut off.

18. An electrical contact assembly for electrical and mechanical connection to conductive and metal areas of a printed circuit board, comprising;

spaced electrical contact members having contact sections and leg sections;

a dielectric housing molded onto parts of the leg sections so that exterior parts of the leg sections extend outwardly from front and rear surfaces of the housing and the contact sections are positioned within the housing;

some of the exterior parts of said leg sections being electrically connectable to the conductive areas of the circuit board while the other of the exterior parts of the leg sections are mechanically connectable to the metal areas of the circuit board;

a cover member is pivotally mounted onto said housing and is movable from an open to a closed position; and latch means are provided on said housing and cover member to latch said cover member in said closed position.

19. An electrical contact assembly as claimed in claim 18, wherein the contact sections are cut from interior parts of the leg sections thereby forming cantilever spring contact sections.

20. An electrical contact assembly as claimed in claim 19, wherein the exterior parts of the leg sections that are part of the spring contact sections have sections that extend outwardly from the housing in the same plane of the bottom surface of the housing.

21. An electrical contact assembly as claimed in claim 19, wherein the exterior parts of the leg sections that are unconnected to the spring contact sections have sections that extend outwardly from the housing in the same plane of the bottom surface of the housing.

22. An electrical contact assembly as claimed in claim 19, wherein the exterior parts of the leg sections that are unconnected to the spring contact sections have some sections that extend outwardly from the housing in the same plane as the bottom of the housing while other of the sections are cut off.

23. An electrical contact assembly as claimed in claim 18, wherein said housing has pivot projections and said cover member has rectangular openings in which said pivot projections are disposed enabling said cover member to move along said housing.

* * * * *

UNITED STATES PATENT OFFICE

CERTIFICATE OF CORRECTION

Patent No. 4,936,792 Dated June 26, 1990

Inventor(s) Nobuaki Onoue, Akira Imai

It is certified that error appears in the above-identified patent and that said Letters Patent is hereby corrected as shown below:

On the title page, item [57] ABSTRACT:

Line 18 - the word "section" should be --sections--.

Claim 8, Column 6, Line 60 - the word "im" should be --in--.

Claim 8, Column 6, Lines 63 and 64 - the word "exposed" should be --disposed--.

Signed and Sealed this

Ninth Day of June, 1992

*Attest:*

*Attesting Officer*

DOUGLAS B. COMER

*Acting Commissioner of Patents and Trademarks*